US008334765B2

(12) United States Patent
Weinstein et al.

(10) Patent No.: US 8,334,765 B2
(45) Date of Patent: Dec. 18, 2012

(54) WIRELESS NETWORK APPARATUS AND METHOD FOR LOCK INDICATION

(75) Inventors: Hillel Weinstein, Tel Aviv (IL); Yeshayahu Strull, Tel Aviv (IL)

(73) Assignee: Keylockit Ltd., Tel Aviv (IL)

( * ) Notice: Subject to any disclaimer, the term of this patent is extended or adjusted under 35 U.S.C. 154(b) by 140 days.

(21) Appl. No.: 12/913,803

(22) Filed: Oct. 28, 2010

(65) Prior Publication Data

US 2011/0285528 A1 Nov. 24, 2011

Related U.S. Application Data

(60) Provisional application No. 61/347,461, filed on May 24, 2010.

(51) Int. Cl.
*G08B 1/08* (2006.01)

(52) U.S. Cl. ..... 340/539.11; 340/3.9; 340/5.1; 340/5.61

(58) Field of Classification Search ..... 340/539.11, 340/5.1, 5.64, 3.9
See application file for complete search history.

(56) References Cited

U.S. PATENT DOCUMENTS

| | | | | |
|---|---|---|---|---|
| 2007/0090921 | A1 * | 4/2007 | Fisher | 340/5.73 |
| 2009/0273438 | A1 * | 11/2009 | Sultan et al. | 340/5.7 |
| 2009/0293567 | A1 * | 12/2009 | Yuen et al. | 70/391 |
| 2010/0117868 | A1 * | 5/2010 | Van Wiemeersch et al. | 340/989 |

* cited by examiner

*Primary Examiner* — Hai Phan
*Assistant Examiner* — Ojiako Nwugo
(74) *Attorney, Agent, or Firm* — Soroker Agmon Advocates and Patent Attorneys

(57) ABSTRACT

An apparatus for tracking the status of a lock, comprising: at least one lock tracking device for tracking a status of a lock; and at least one wireless key unit; wherein each of said at least one wireless key unit is connected to one of said at least one lock tracking device, and wherein said at least one wireless key unit includes a transceiver unit for transmitting information obtained from the at least one lock tracking device regarding the status of the lock.

19 Claims, 7 Drawing Sheets

WIRELESS NETWORK APPARATUS AND METHOD FOR LOCK INDICATION

RELATED APPLICATIONS

This application claims priority from provisional patent application Ser. No. 61/347,461 filed on May 24, 2010 titled Wireless Network System and Method for Lock Indication, the disclosure of which is incorporated herein by reference.

This application is related to patent application serial number U.S. Ser. No. 12/882,236 filed on Sep. 15, 2010 titled AN APPARATUS AND METHOD FOR ELECTRONIC LOCK KEY INDICATOR (hereinafter "lock key indicator application"), the disclosure of which is incorporated herein by reference.

BACKGROUND

The present disclosure relates to tracking the status of a lock in an environment that that includes one or more keys in general, and to providing an indication of the status of a lock corresponding to said keys, being either locked or unlocked.

Quite often, people forget whether they have locked the door in the house, office, or other premises, or not. As a common occurrence—someone may depart a building intending to secure it by externally locking a certain door using its corresponding key, upon departure. However, following his departure, he or she may be unable to recall whether or not they have actually locked the door, securing it by turning the corresponding key into a locked position. Hence, there is a need to provide a reliable, low-cost, convenient device which may be attached to the majority of portable keys, which device shall clearly indicate whether the lock corresponding to said key has been actuated into the lock position or not.

Furthermore, there are cases when there is a need to provide the lock's status to a remote control or display unit, such as a central alarm control unit, for example when a bank or jewelry main office wants to monitor the status of the locks of all branches.

Several inventors have suggested various devices including attachments to standard keys that would hopefully indicate the most recent lock position. However, most of the present inventions describing a certain electro-mechanical attachment to a certain mechanical key do not offer a true indication of the most recent status of the corresponding lock in the case of multiple key-holders using a common lock; e.g.—one key holder may lock the door such that his attached indicator will indicate "lock" status. Subsequently, a second user may unlock the same door; however, the indicator of the first user will still indicate a "lock" status, which clearly does not reflect the true, recent status of the lock. This discrepancy is clearly due to the fact that there is no channel of communication between the devices attached to the keys of the different users. These devices also do not enable the key-holder an automatic update method to provide the status of the lock to a remote control/display unit.

BRIEF SUMMARY

The present disclosure introduces an electronic apparatus and method, included within a housing that can be attached to most of the known keys, providing an indication of the most recent status of the lock corresponding to said key. Said device shall indicate whether the lock was left locked.

The disclosures referenced above introduced an electronic apparatus and method, included within a housing that can be attached to most of the known standard keys, providing an indication of the most recent status of the lock corresponding to said key. Said device indicates to the individual user whether he or she left the lock in a locked or unlocked position.

The present invention enables a reliable indication of the most-recent status of the lock in case of multiple key holders to the same lock. In accordance with a preferred embodiment of the present apparatus, a wireless communication network is established among all individual key-holders of a given lock, such that each key-holder using the attached indicator—housing referenced above is provided with the electronic signals indicating the true most-recent status of the lock as determined by the most-recent activator of the lock. In addition, a central Monitoring system, which includes a Display terminal or terminals, may clearly display the updated status of many individual locks using said wireless network.

In accordance with a preferred embodiment of the present apparatus, each key is provided with an attached housing which includes the electronic components indicating the last lock-position of the lock corresponding to the key in accordance with the teachings of the related applications referenced above, or any other electronic lock-position indicator. A wireless transceiver, included within said housing, is attached to said electronic indicator. Said transceiver transmits a signal to a wireless network, indicating the most recent status of the lock, as indicated by the electronics included in said attached housing. Other key holders have identical housings attached to their keys, which housings include identical wireless transceivers. A central transceiver is located in the wireless network interfacing with a central server-controller. Said server/controller issues update-signals to all key-holders of a corresponding lock indicating the most recent status of the lock as determined by the most recent activator of said lock.

In some exemplary embodiment of the disclosed subject matter, a cellular network may be used such that all key holders are connected to said cellular network via standard cellular phones which they carry. The transceiver included within the key-housing attachment transmits a lock-status signal to the portable Cellular device, using—for example—a standard Blue-Tooth interface. The Cellular device is programmed to transmit the most recent status of the lock, as updated by its Blue-Tooth interface, through the cellular network to said server-controller, which proceeds to update all other Cellular devices corresponding to the specific lock, with the most recent status of the lock. The Cellular devices, through their Blue-Tooth interfaces, proceed to transmit the updated status to the receivers included within the transceivers connected within each Key-housing attachment, such that a most-recent status of the lock is displayed on each of the key electronic indicators. The combination of said cellular device with the electronic key indicator facilitates a low-cost implementation of lock status indication to disperse multiple users holding identical keys of the same lock, without requiring the installation of a costly, gateway and/or server at each lock position. This is facilitated by programming the cellular device to identify the individual key holder, that is identified by a unique code assigned to him, and transmit its most recent lock or unlock action, which action corresponds to the most recent status of the lock, through the cellular network, and/or receive the most recent action by other identical key-holders of the same lock.

In yet another exemplary embodiment in accordance with the disclosed subject matter, said server-controller can be interfaced and programmed to display the lock status of said lock, as well as the lock status of many other locks, each of which is assigned with a unique code identifying a particular lock. Such monitoring apparatus enables updating of a central control in the status of all locks included within a given building, campus, or wider geographic area covered by the cellular network. This feature is applicable also to an environment that includes only a single key. Moreover, since each key holder within the system is assigned a unique code, the central control system can display who actually was the most recent user that opened or closed the lock.

In some other exemplary embodiment of the disclosed subject matter, an Internet network can be used for electronic lock-status indication. An Internet network may be used such that all key holders are connected to said Internet network via portable devices such as standard cellular phones which they carry, or any other mobile terminal, including but not limited to PDA's, Palm Computers, Notebook computers, etc. The transceiver included within the key-housing attachment transmits a lock-status signal to the portable device, using—for example—a standard Blue-Tooth interface' or a so-called standard Wi-Fi interface, etc. The portable device is programmed to transmit the most recent lock status, through the Internet network to said server controller, which proceeds to update all other devices corresponding to the specific lock, with the most recent lock-status. The portable programmable devices, through their interfaces, proceed to transmit the updated status to the receivers included within the transceivers connected within each Key-housing attachment, such that a most-recent lock status is displayed on each of the key electronic indicators. The combination of said device with the electronic key indicator facilitates a low-cost implementation of lock status indication to dispersed multiple users of the same lock, without requiring the installation of a costly, gateway and/or server at each lock position.

In the Internet network implementation described above, said server-controller can be interfaced and programmed to display the lock status of said lock, as well as the lock status of many other locks, each of which is assigned with a unique code identifying a particular lock. Such monitoring system enables updating of central control in the status of all locks included within a given building, campus, or wider geographic area covered by the wireless network.

In another exemplary embodiment of the disclosed subject matter, each one of the personal cellular and/or portable device transceivers referenced above can be programmed such that each time it receives an electronic signal indicating an unlock (open) and/or lock electronic signal, corresponding to the given lock, from the cellular and/or Internet network, it will cause said transceiver to issue an alarm which may be audible and/or visual—as displayed on the screen of said cellular or other portable device. Said alarm will alert the key-holder to the recent status of the lock.

In another exemplary embodiment in accordance with the disclosed subject matter, whenever a locking or unlocking operation is detected by the lock tracking device, the wireless key unit activates or deactivates an alarm system.

In an exemplary embodiment in accordance with the disclosed subject matter there is provided an apparatus for tracking a status of a lock, comprising: at least one lock tracking device for tracking the status of the lock; and at least one wireless key unit; wherein each of said at least one wireless key unit is connected to one of the at least one lock tracking device, and wherein said at least one wireless key unit includes a transceiver unit for transmitting information obtained from the at least one lock tracking device regarding the status of the lock.

In an exemplary embodiment in accordance with the disclosed subject matter the apparatus wherein the at least one lock tracking device is adapted to be attached to a key used to lock or unlock said lock In an exemplary embodiment in accordance with the disclosed subject matter the transceiver unit receives information regarding the status of the lock.

In an exemplary embodiment in accordance with the disclosed subject matter the apparatus further comprising a lock status control unit for receiving information regarding the status of the lock from the at least one wireless key unit and wherein the lock status control unit is tracking the status of the lock.

In an exemplary embodiment in accordance with the disclosed subject matter the lock status control unit further transmits information regarding the status of the lock to the at least one wireless key unit.

In an exemplary embodiment in accordance with the disclosed subject matter the apparatus further comprising a monitoring unit that receives information regarding the status of the lock from the lock status control unit and provides a visual display of the status of the lock.

In an exemplary embodiment in accordance with the disclosed subject matter the at least one wireless key unit transmits information obtained from the at least one lock tracking device regarding the status of the lock to the lock status control unit via a portable transceiver device.

In an exemplary embodiment in accordance with the disclosed subject matter, the information that is transmitted from the lock status control unit and is received by the at least one wireless key unit provides indication about the most recent status of the lock.

In an exemplary embodiment in accordance with the disclosed subject matter the portable transceiver device is a mobile phone.

In an exemplary embodiment in accordance with the disclosed subject matter the lock status control unit is connected to a wireless network and wherein the lock status control unit receives information regarding the status of the lock from the at least one wireless key unit via said wireless network.

In an exemplary embodiment in accordance with the disclosed subject matter the wireless network is a data network.

In an exemplary embodiment in accordance with the disclosed subject matter the lock status control unit is further keeping updated records of each transmission that were received from each of the at least one wireless key unit.

In an exemplary embodiment in accordance with the disclosed subject matter the at least one wireless key unit communicates with a monitoring device.

In an exemplary embodiment in accordance with the disclosed subject matter the at least one wireless key unit communicates with a remote controlled device.

In an exemplary embodiment in accordance with the disclosed subject matter the remote controlled device is a premises control system.

In an exemplary embodiment in accordance with the disclosed subject matter the remote controlled device is an alarm system.

In an exemplary embodiment in accordance with the disclosed subject matter the at least one wireless key unit activates or deactivates the remote controlled device responsive to detection of a locked or unlocked lock status by the at least one lock tracking device.

In an exemplary embodiment in accordance with the disclosed subject matter there is provided a method for tracking a status of a lock, comprising tracking the status of the lock with a lock tracking device that is adapted to be attached to a key that is used for lock or unlock said key; and transmitting information obtained from said lock tracking device by a wireless key unit that is connected to said lock tracking device.

In an exemplary embodiment in accordance with the disclosed subject matter a transceiver unit receives information regarding the status of the lock.

In an exemplary embodiment in accordance with the disclosed subject matter a lock status control unit receives information regarding the status of the lock from an at least one wireless key unit and wherein the lock status control unit is tracking the status of the lock.

In an exemplary embodiment in accordance with the disclosed subject matter the lock status control unit further transmits information regarding the status of the lock to the at least one wireless key unit.

In an exemplary embodiment in accordance with the disclosed subject matter a monitoring unit receives information regarding the status of the lock from the lock status control unit and provides a visual display of the status of the lock.

In an exemplary embodiment in accordance with the disclosed subject matter the at least one wireless key unit transmits information obtained from the at least one lock tracking device regarding the status of the lock to the lock status control unit via a portable transceiver device.

THE BRIEF DESCRIPTION OF THE SEVERAL VIEWS OF THE DRAWINGS

The present disclosed subject matter will be understood and appreciated more fully from the following detailed description taken in conjunction with the drawings in which corresponding or like numerals or characters indicate corresponding or like components. Unless indicated otherwise, the drawings provide exemplary embodiments or aspects of the disclosure and do not limit the scope of the disclosure. In the drawings.

DETAILED DESCRIPTION

All technical terms used herein have the same meaning as commonly understood by one skilled in the art pertaining to the invention and in the art of electronics.

The disclosed subject matter is described below with reference to flowchart illustrations and/or block diagrams of methods, apparatus (systems) and computer program products according to embodiments of the subject matter. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, digital controller, or other programmable data processing apparatus to produce a machine, such that the instructions, which execute via the processor of the computer or other programmable data processing apparatus, create means for implementing the functions/acts specified in the flowchart and/or block diagram block or blocks.

U.S. patent application Ser. No. 12/882,236 filed on Sep. 15, 2010, (hereinafter "lock tracking device application") the disclosure of which is incorporated here by reference, describes electronic devices and systems, included within a housing that can be attached to most of the known mechanical-access keys, providing an indication of the most recent status of the lock corresponding to said key as determined by the most recent action of the key holder of said key. According to the teachings of said referenced patent-applications, when the key holder inserts the key into the corresponding lock, locking or unlocking the lock, an electronic signal is generated, which signal is fed to an electronic indicator which displays the most recent status of the lock, i.e.—indicating whether said lock was left in a lock or unlock position, as determined by said individual keyholder.

The present disclosure describes electronic devices and wireless communication systems enabling the indication of the most recent status of the lock as relayed to a plurality of several key holders holding keys with attached housings which correspond to said lock, as determined by the most recent activator of said lock, which activator is a member of the group of key-holders.

Figure 1A:
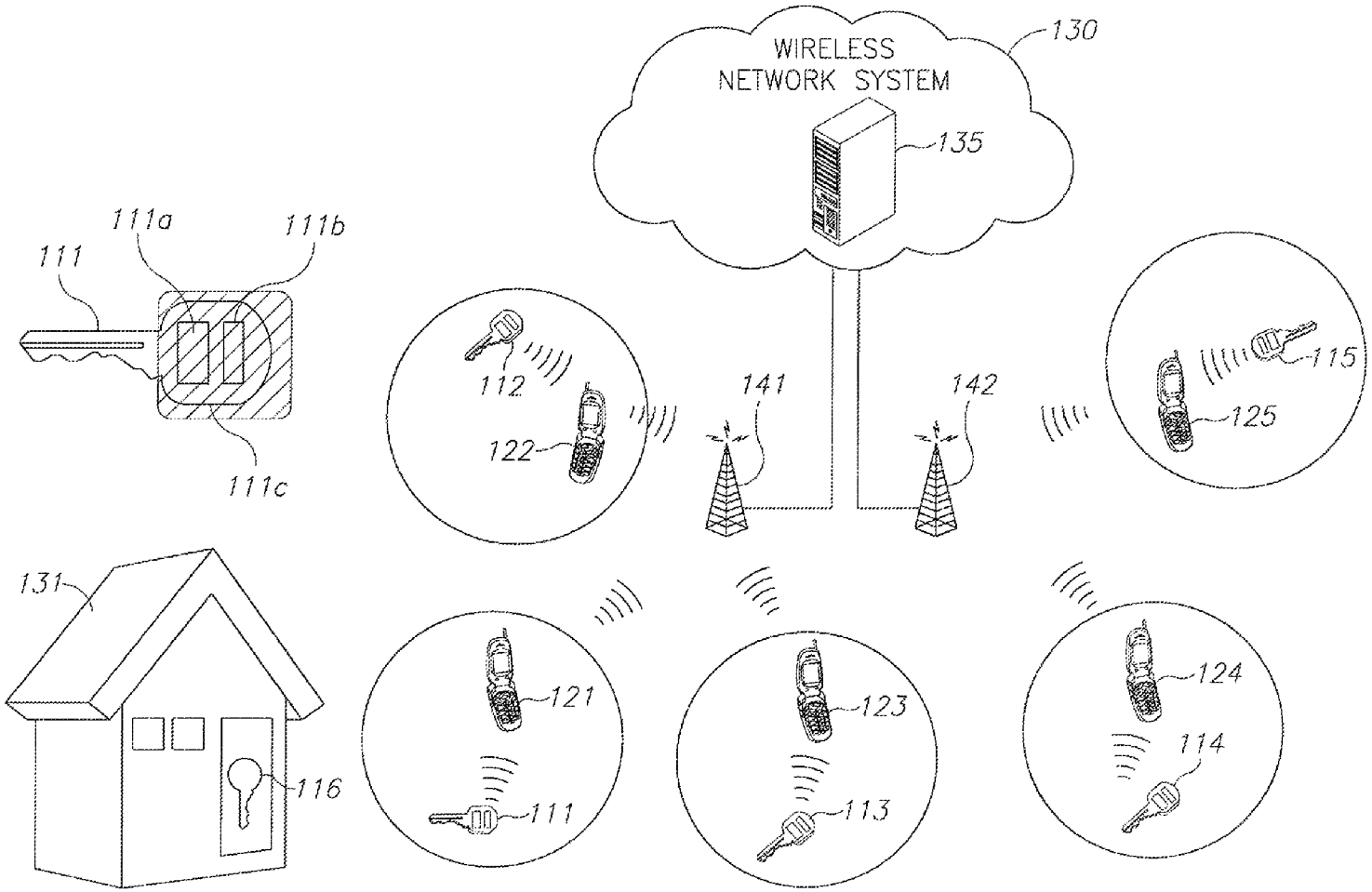
FIG. 1A illustrates a wireless apparatus for a standard key and lock in accordance with the disclosed subject matter.

Referring to FIG. 1A, describing that key 111 includes an electronic key housing 111C that is divided to two schematic units: a lock tracking device 111*a* and wireless key unit 111*b*. When further references in the present disclosure are made to the keys (such as 112,-115 or 161-168) it is assumed that a key housing 111*c* is attached to the key including the lock tracking device 111*a* and the wireless key unit 111*b*.

One embodiment of a lock tracking device is described in greater detail in the Patent Applications referenced above. The electronic key housing in accordance with the present disclosure is modified by an addition of a low-power transceiver unit (hereinafter "wireless key unit") as described below.

It should be noted that the present disclosure is not limited to the lock tracking device that is described in the lock key indicator application, thus, any other lock tracking device which isszues an electronic signal indicating the most recent status of the corresponding lock can also be used and included within element 111*a* to which said wireless key unit will be added.

The lock tracking device 111*a* tracks the key movements and as described in detail in the lock tracking device application, detects clock or counter clock rotations of the key and identifies locking or unlocking of the lock. The lock tracking device is connected to the wireless key unit 111*b* and provides information about the lock status to the wireless key unit 111*b*. The wireless key unit 111*b* transmits the information that was obtained from the lock tracking device by a transceiver unit 440 (shown in FIG. 4)

It should be noted that the figures and description refer to two separate elements 111*a* 111*b* in order to describe the apparatus functionality, practically both units 111*a* and 111*b* may be integrated in a way that it will not be possible to physically separate them, for example both units may share a common processor or any other component.

The wireless key unit (each one includes a transceiver 440 shown in FIG. 4) included within electronic key housing 111*c* communicate over relatively short ranges. FIG. 1A shows five keys 111-115 (each key includes the electronic key housing 111*c* and the lock tracking device 111*a* and wireless key unit 111*b*). Several key-holders of said keys are termed "users". Each user is assigned a unique code—(the code is defined within the electronic key housing 111*c*) which identifies him-and is equipped with an additional portable electronic transceiver such as, but not limited to, a cellular phone/mobile phone 121, 122, 123, 124 and 125 respectively. The cellular phones 121-125 are just an example and could be replaced by any portable wireless device (hereinafter "portable transceiver device"). Said portable transceiver devices are receiving wireless data from keys 111-115 (the data being transmitted from the wireless key unit 111*b* that includes a transceiver unit 440) while transmitting and/or receiving information through base-stations 141, 142, which are interconnected among themselves by means of a Wireless Network, 130. The network may, for example be a Cellular network, or an Internet network accessed by the well-known WiFi wireless interface. The most recent user activates lock 116 located in building 131 using key 111. Following said activation, wireless key unit 111*b* communicates with portable wireless device 121, providing information about the lock/unlocking activity, and then his portable wireless device 121 transmits electronic signals which identify said most recent user as well as the most recent status of lock 116 to the wireless network which includes a server 135 (hereinafter lock status control unit) programmed to store said most recent status of said lock. The server may keep records of all locking/unlocking activities and may keep updated records of the transmissions that were received from each of the wireless key units. Each one of the users can now interrogate said server (lock status control unit) 135, and receive the most recent status of said lock, i.e.—locked or unlocked position. The specific key-housings referenced above are shown as an exemplary embodiment in accordance with this disclosure and can also be replaced by any other electronic device that transmits signals indicating the most recent status of the lock as determined by said key-housings holder.

According to the teachings of this disclosure, the lock tracking device 111*a* in combination with the wireless key unit 111*b*, both battery operated, enable the realization of true indication of the lock status to multiple key-holders without the need for a multitude of local servers and/or gateways to be located in each house 131, where lock 160 is located, and without requiring external power to be fed to either said lock or said local gateway/server. Only one central server (lock status control unit) 135 is required as described below.

The wireless system and method according to the present disclosure may, for example, be a cellular wireless network with cellular phones born by each user. Yet another embodiment in accordance with the disclosed subject matter may utilize an Internet network with the well known WiFi interfaces and protocols located in each portable wireless device 121-125 as well as in the network servers, or any other wireless network. The wireless apparatus and method according to the present disclosure may also be a combination of different wireless networks for example one user may use a cellular phone device while another user communicates with a WiFi device wherein both devices are connected to the internet.

It should be noted that while the present disclosure describes a limited number of communication schemes, the wireless key unit 111*b* (as described below in more detail and referred to as transceiver unit 440 portrayed in FIG. 4) that is connected to the lock tracking device 111*a* may connect and be integrated into any communication model. Key unit 111*b* may be implemented in various formation, it may include a Bluetooth transceiver, or a cellular transceiver, a WIFI transceiver, a LED or Infra-Red (I/R) transceiver. Furthermore, unit 111*b* may be differently implemented in any of the keys 111-115 as long as each of the wireless key units is adapted to connect to the wireless network.

Figure 1B:
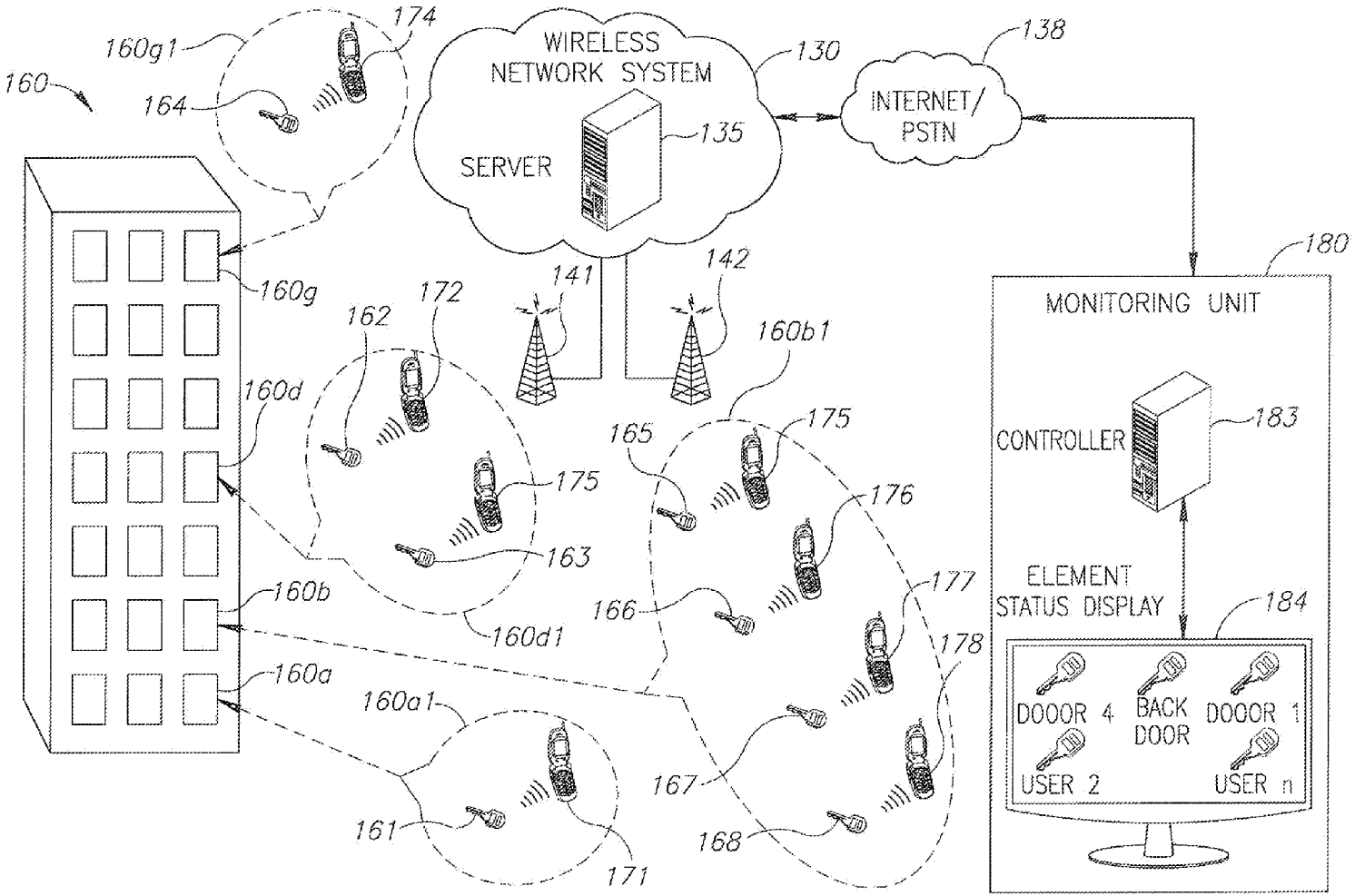
FIG. 1B illustrates a central monitoring apparatus via Internet or PSTN in accordance with the disclosed subject matter

A central monitoring system is introduced in FIG. 1B. Building 160, which may also represent a group of buildings and/or other premises, includes a multitude of locks 160*a*-160*g*. To each of said locks there corresponds a group of keyholders, 160*a*1, 160*b*1 . . . 160*g*1. Each of which is equipped with a key (As before mentioned each key, such as key 161 includes an electronic key housing 111*c* that further includes a lock tracking device 111*a* and a wireless key unit 111*b*) the keys are marked 161-168, group 160*a*1 includes only one key 161, group 160*b*1 includes four keys 165,166, 167 and 168.

Each of the wireless key units 111*b* is in communication with a portable wireless device marked 171-178. In accordance with the description provided above, the most recent activator of any given lock transmits the most recent status of each lock (160*a*-160*g*) from the keys (161-168) to the corresponding portable wireless device 171-178, that further communicates with wireless network 130 such that its signal is received by server (lock status control unit) 135 of wireless network 130, which network may be a cellular network, can be connected either through the Internet or through a PSTN (Public Switched Telephone Network) 138 to a monitoring unit 180. Said monitoring unit includes controller 183 which may interface with status display unit 184. Each lock 106*a*, 106*b*, etc. is assigned a digital code, and each key-housing 111*c* (included in all the keys 161-168) is also assigned a digital code associated with the given lock to which said key corresponds, such that controller 183 receives the sequences of signals uniquely indicating the most recent status of each lock, as well as retaining historical statistics showing which specific keys engaged their corresponding locks at what specific dates and time instants.

It should be noted that FIG. 1B shows portable phone devices 171-178 that communicate with wireless network 130, by a way of a non-limiting example. Each of the wireless key units 111*b* (included within key-housings 111*c*—not shown in FIG. 1B) may communicate with wireless network 130 in any possible communication scheme, either directly or by usage of any mediator/repeater device.

Figure 1C:
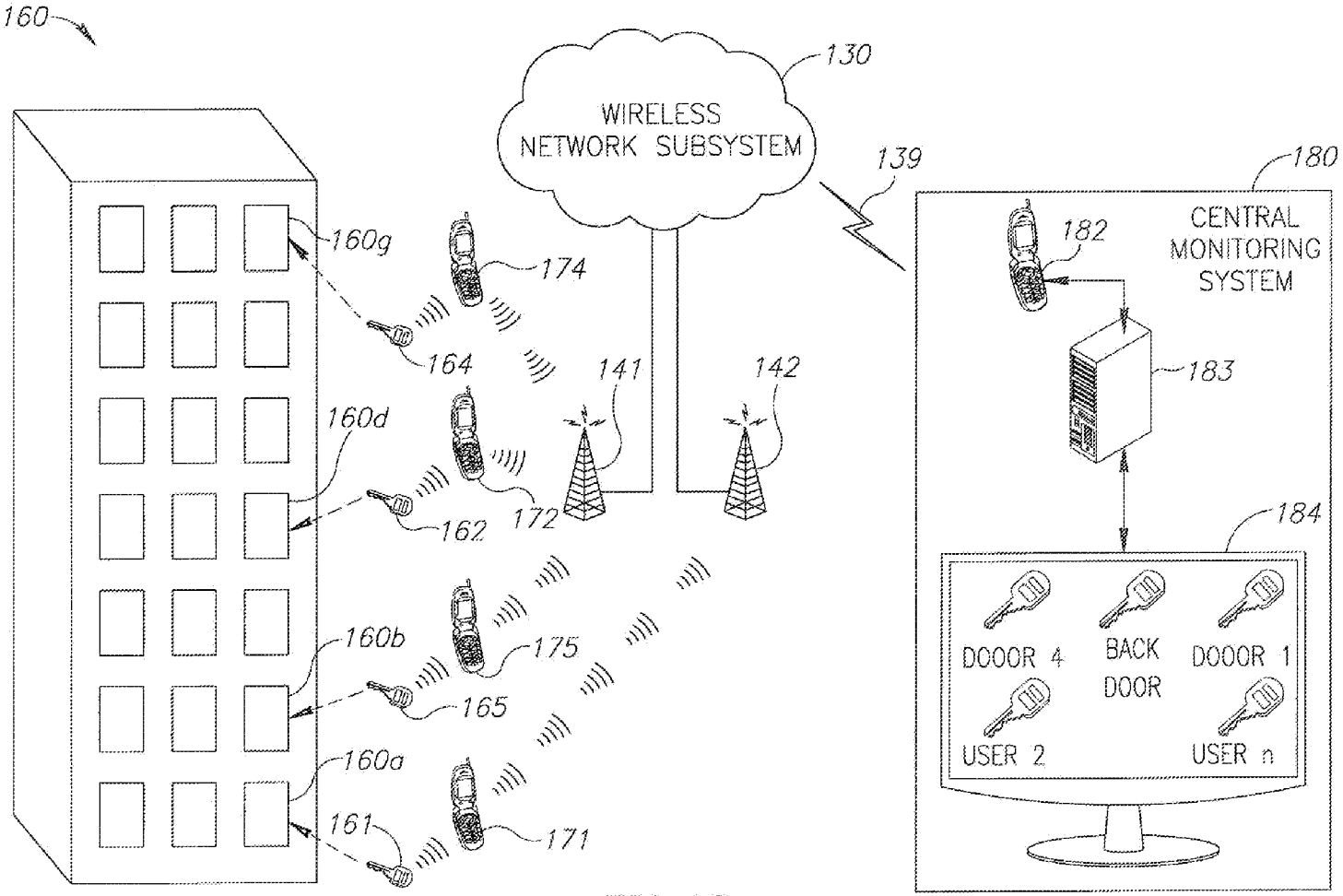
FIG. 1C illustrates a central Monitoring apparatus via a cellular Network in accordance with the disclosed subject matter.

FIG. 1C illustrates a monitoring system based on the description provided above for FIG. 1B, but with the interconnection link between the monitoring system 180 and the wireless cloud based on a cellular link 139.

Figure 2:
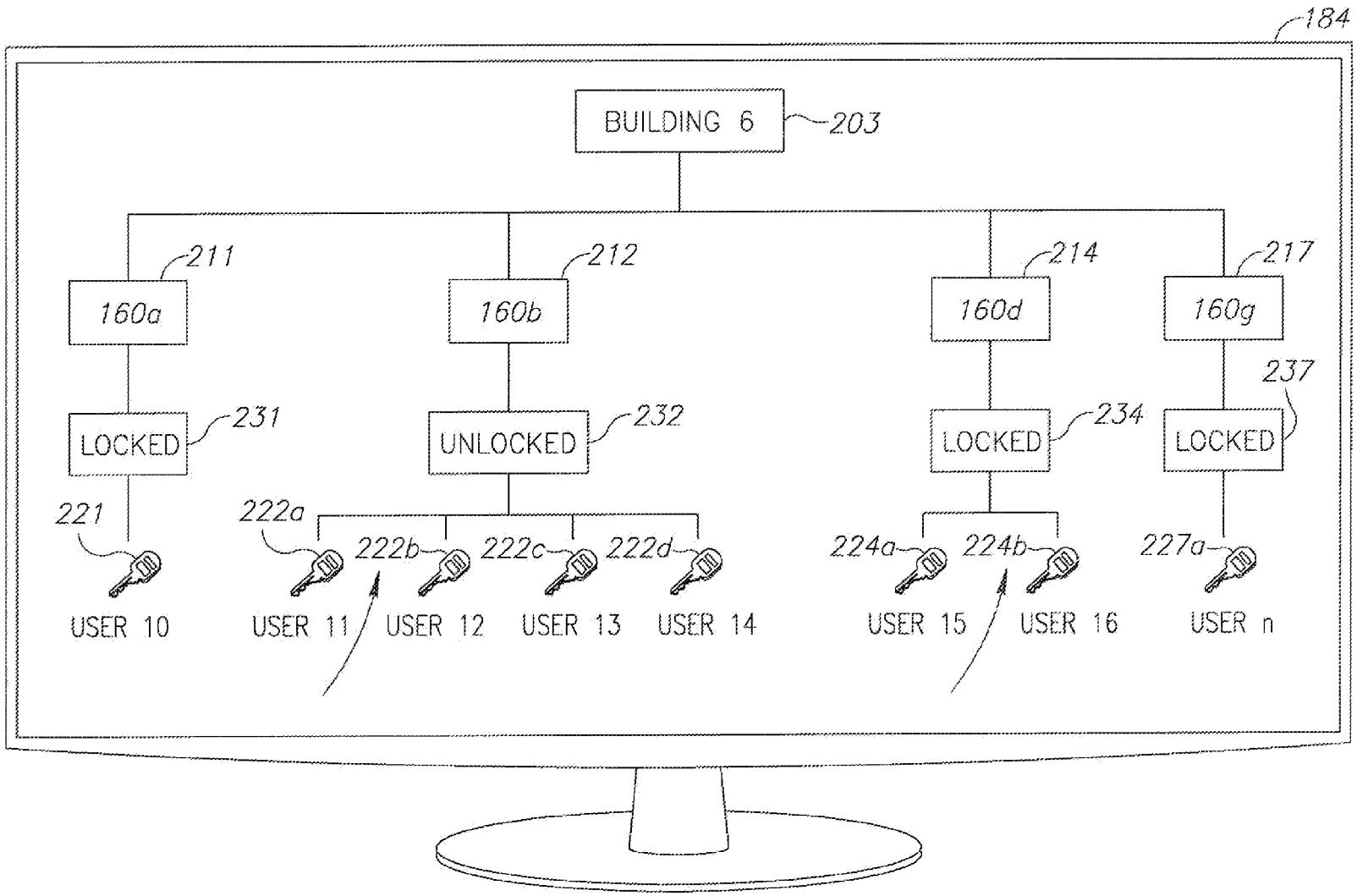
FIG. 2 illustrates a display of a monitored system in accordance with the disclosed subject matter

FIG. 2 illustrates a status display unit of the monitoring unit in accordance with the disclosed subject matter, described in FIGS. 1B,1C above, with an example of the status of various locks included within the given premises. The status display unit 184 shows building 6, 203 and its locks, 160*a*, 160*b*, 160*d*, 160*g*, marked 211,212,214 and 217 respectively. Below each lock there is a visual display of the lock status 231,232,234 and 237 respectively showing if the lock is locked 231,234,237 or unlocked 232. The key holders of each lock that are associated with key housing 111*c* are shown below each lock. key-housing 221 for lock 211, key-housings 222*a*,222*b*,222*c* and 222*d* for lock 212 etc. Optionally there is also indication by an arrow showing the most recent lock activator, 222*b* for lock 212 and 224*b* for lock 214. The viewer of said display can clearly see which lock within his monitored system is locked or unlocked, and also be aware of the most recent lock activator which might be very important in certain systems.

Figure 3:
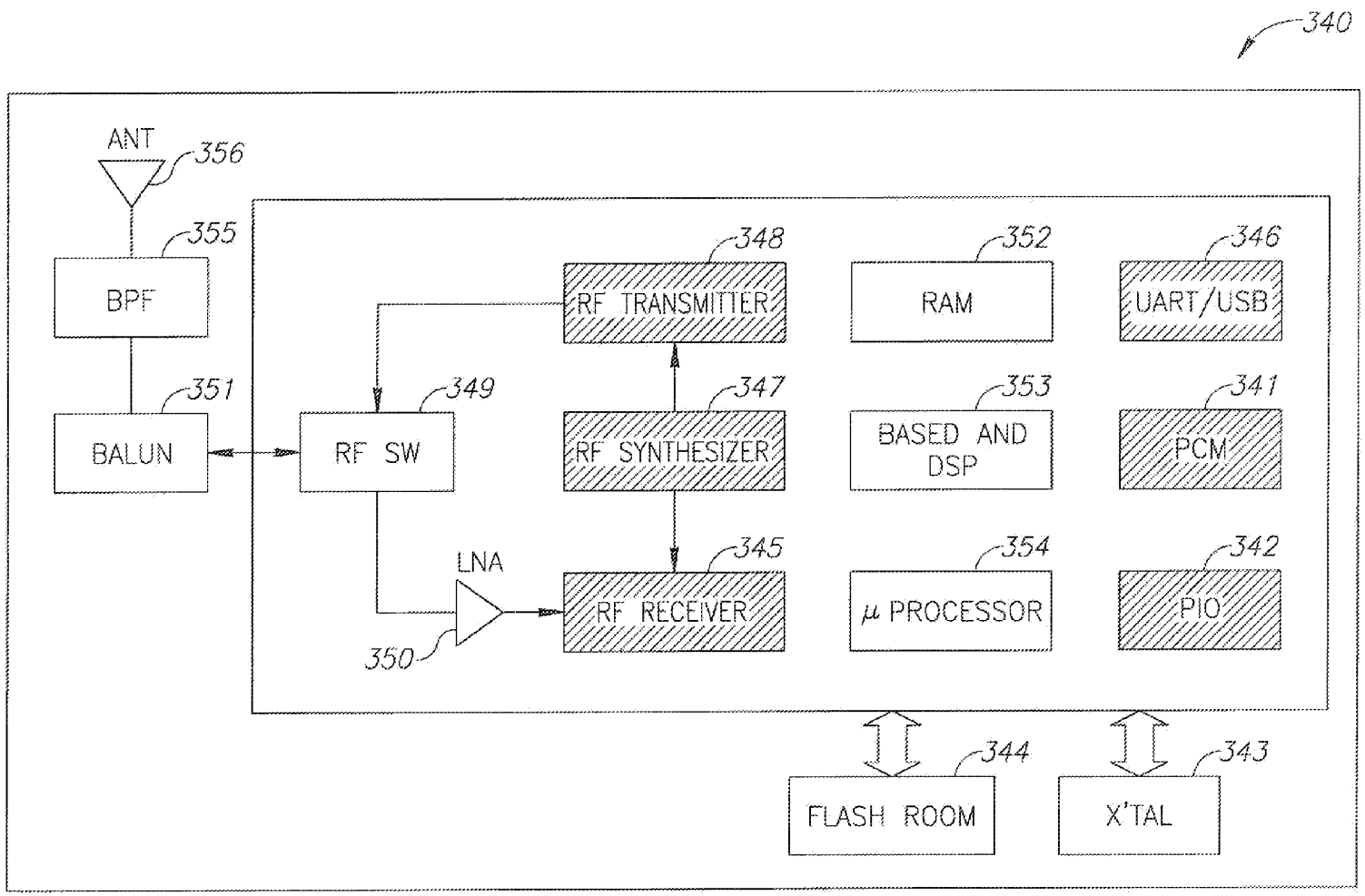
FIG.3 PRIOR ART
FIG. 3 illustrates a typical Bluetooth module block diagram. (Prior Art)

One exemplary embodiment in accordance with the disclosed subject matter is illustrated in FIG. 3 which depicts a typical block diagram of a specific Bluetooth wireless transceiver 340 currently deployed in many cellular handsets and systems intended for short range wireless communication and incorporate low power consumption and low cost technology. It may be connected to sensor device via Input and Output Port 342 and transmits/receive radio signals via the Antenna 356 upon request from the sensor. So as the sensor indicates the change in status of its corresponding lock, it sends a signal to the I/O port 342. The module may be comprised of a PCM sub module 341 that may receive analog voice signal and transform it to a digital format. It may be connected to a digital source or computer via sub module UART/USB 346 interface. RAM 352 and Flash ROM 344 contain the appropriate software codes. Microprocessor 354 and Baseband DSP 353 manipulate the digitized signals. The RF Transmitter 348 transmits the data signal to the antenna 356 via RF Switch 349 Balun 351 and BPF 355 RF switch 349 protects the RF Receiver 345 from the RF Transmitter 348 during transmission. Balun 351 Transform the single ended signal from the Antenna 356 to a differential signal. BPF 355 is a band pass filter that protects the module against out of band strong signals LNA 350 which is a low noise amplifier determines the RF Receiver 345 noise level. X'TAL 343 is the stable reference oscillator of the module.

Figure 4:
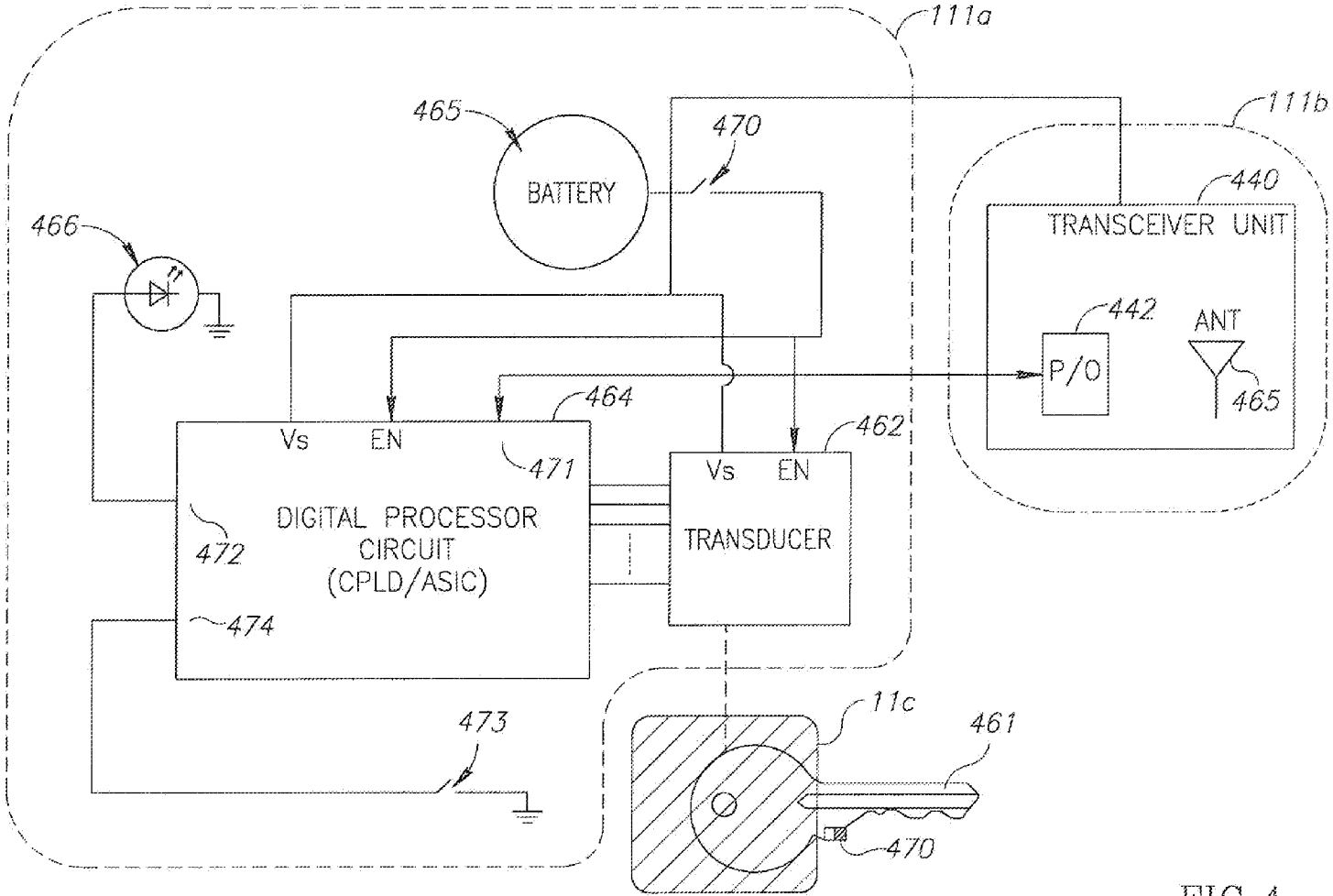
FIG. 4 illustrates a key lock Indication element including a wireless connectivity module connectivity in accordance with the disclosed subject matter.

An exemplary embodiment of this invention is illustrated in FIG. 4 which provides more detailed description to explain how the various electronic components are interconnected within Key housing 111*c*. FIG. 4 shows the schematic division between the two units: lock tracking device 111*a* and wireless key unit 111*b*, both included within housing 111*c*. As before mentioned this is only a schematic division, as practically the two units may be integrated and may share certain components. In this figure, a single electronic lock indicator substantially designed in accordance with the teachings of the referenced U.S. patent application Ser. No. 12/882,236. Transducer 462, which may be an accelerometer, or any other motion-sensor, senses the direction of rotation of key 461 about the longitudinal axis of the key, proceeding to issue electronic digital signals indicating a lock or unlock status of the corresponding lock. Digital processor circuits 464 proceed to issue lock or unlock indicating signals to the display LED 466, which LED is activated by means of Status Switch 473. In accordance with the teachings of the present invention, a wireless transceiver module 440, as described, for example, in FIG. 3 above, is now added within the housing 111*c*, receiving its power from the Battery 465. Insertion-switch 470 that is located on the key or the housing is used to sense the complete insertion of the key into the lock-cylinder—thus initiating the detection process. It should be noted that wireless key unit 111*b* may include additional components apart from transceiver module 440, to support features that may require programming or configuration by the manufacture or later by the key holder.

Figure 5:
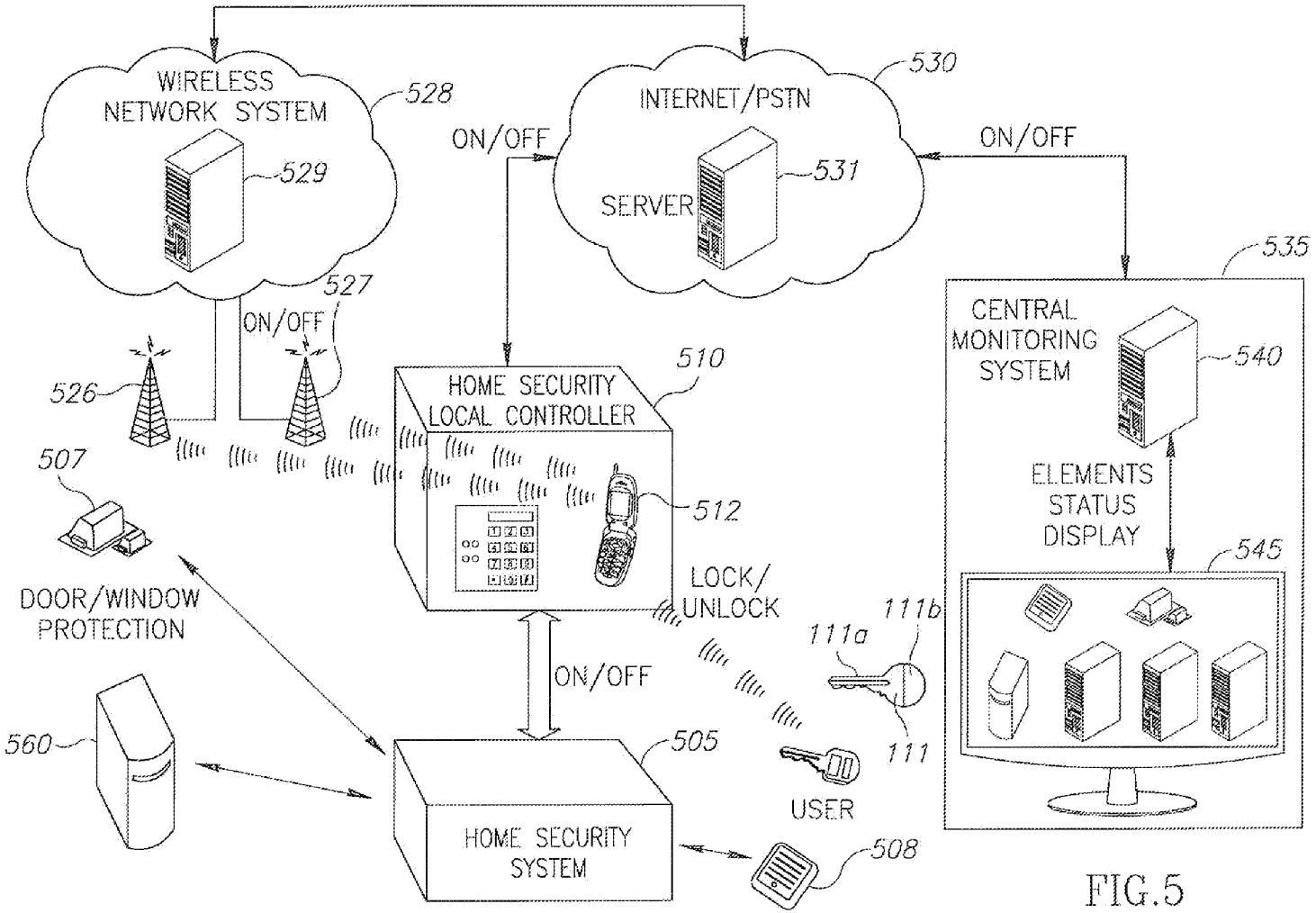
FIG. 5 illustrates integration between a wireless apparatus for lock status indication and an alarm system in accordance with the disclosed subject matter

FIG. 5 illustrates integration between a wireless apparatus for lock status indication and a home-security system. In accordance with the disclosed subject matter FIG. 5 shows a key 111 (including an electronic key housing 111*c*—not shown in FIG. 5) that has the wireless key unit 111*b* in wireless connection with home security local controller 510 that includes wireless unit 512 (such as cellular phone).

In one embodiment, wireless key unit 111*b* activates an alarm system 505 (such as a home security alarm system) whenever the lock tracking device 111*a* detects a locked lock-status and deactivates the alarm system 505 whenever lock tracking device 111*a* detects an unlocked lock-status.

In another embodiment in according with the disclosed subject matter, activation/deactivation of the alarm system is programmable, thus, activation/deactivation is responsive to detection of a locked/unlocked lock status, it may be automatically chosen as default programming or set manually by the user and/or Central Controller selection.

As shown in FIG. 5 home security local controller 510 is connected either by internet/PSTN connection or by cellular network 528 (or by both type of communication) to a central security controller 535 that includes a server 540 and a monitor 545.

It should be noted that FIG. 5 shows a home security local controller by a way of a non-limiting example; the present disclosure is not limited to activation/deactivation of a home security local controller but can activate/deactivate and perform any control action on any remote controlled device and any monitoring device such as security control, heat control, electric control, appliance control, smart-house system, monitoring display. The apparatus according to the present disclosure may communicate with any premises control system including, but not limited to, automatic triggering of all home electronic control.

It should be appreciated that the above described methods and apparatuses may be varied in many ways, including omitting or adding steps, changing the order of steps and the type of devices used. It should be appreciated that different features may be combined in different ways. In particular, not all the features shown above in a particular embodiment are necessary in every embodiment of the disclosed subject matter. Further combinations of the above features are also considered to be within the scope of some embodiments of the disclosed subject matter.

Section headings are provided for assistance in navigation and should not be considered as necessarily limiting the contents of the section.

It will be appreciated by persons skilled in the art that the present disclosure is not limited to what has been particularly shown and described hereinabove. Rather the scope of the present disclosure is defined only by the claims, which follow.

The invention claimed is:

1. An apparatus for tracking a status of a lock, comprising:

at least one lock tracking device for tracking the status of the lock, wherein said lock tracking device is attached to a standard key and comprises a movement sensing device for sensing movement of a key relative to said lock and providing movement information about said movement;

wherein said movement information enables tracking the movements of the key and determining the direction of rotation of the key relative to the lock;

at least one wireless key unit; wherein each of said at least one wireless key unit is connected to one of the at least one lock tracking device, and wherein said at least one wireless key unit includes a transceiver unit for transmitting information obtained from the at least one lock tracking device regarding the status of the lock; and a lock status control unit for receiving information regarding the status of the lock from the at least one wireless key unit and wherein the lock status control unit is tracking the status of the lock wherein the lock status control unit is connected to a wireless network and wherein the lock status control unit receives information regarding the status of the lock from the at least one wireless key unit via said wireless network, thereby enabling the indication of the most recent status of the lock as relayed to a plurality key holders holding keys with attached key housings which correspond to said lock.

2. The apparatus according to claim 1, wherein the at least one wireless key unit is adapted to be attached to a standard key used to lock or unlock said lock.

3. The apparatus according to claim 1, wherein the transceiver unit receives information regarding the status of the lock.

4. The apparatus according to claim 1, wherein the lock status control unit further transmits information regarding the status of the lock to the at least one wireless key unit.

5. The apparatus according to claim 4, wherein the information that is transmitted from the lock status control unit and is received by the at least one wireless key unit provides indication about the most recent status of the lock.

6. The apparatus according to claim 4, further comprising a monitoring unit that receives information regarding the status of the lock from the lock status control unit and provides a visual display of the status of the lock.

7. The apparatus according to claim 1, wherein the at least one wireless key unit transmits information obtained from the at least one lock tracking device regarding the status of the lock to the lock status control unit via a portable transceiver device.

8. The apparatus according to claim 7, wherein the portable transceiver device is at least one of a mobile phone, or a cellular phone, or a portable computer, or any combination thereof.

9. The apparatus according to claim 1, wherein the wireless network is a data network.

10. The apparatus according to claim 1 wherein the lock status control unit is further keeping updated records of each transmission that were received from each of the at least one wireless key unit.

11. The apparatus according to claim 1, wherein the at least one wireless key unit communicates with a remote controlled device.

12. The apparatus according to claim 11, wherein the remote controlled device is a premises control system.

13. The apparatus according to claim 11, wherein the remote controlled device is an alarm system.

14. The apparatus according to claim 11, wherein the at least one wireless key unit activates or deactivates the remote controlled device responsive to detection of a locked or unlocked lock status by the at least one lock tracking device.

15. The apparatus according to claim 1, wherein the at least one wireless key unit communicates with a monitoring device.

16. A method for tracking a status of a lock, comprising tracking the status of the lock with a lock tracking device that is attached to a standard key that is used for lock or unlock said lock;

wherein said lock tracking device comprises a movement sensing device for sensing movement of a key relative to said lock and providing movement information about said movement;

wherein said movement information enables tracking the movements of the key and determining the direction of rotation of the key relative to the lock;

transmitting information obtained from said lock tracking device by a wireless key unit that is connected to said lock tracking device, wherein a lock status control unit receives information regarding the status of the lock from an at least one wireless key unit and wherein the lock status control unit is tracking the status of the lock, and further wherein the lock status control unit further transmits information regarding the status of the lock to the at least one wireless key unit, thereby enabling the indication of the most recent status of the lock as relayed to a plurality key holders holding keys with attached housings which correspond to said lock.

17. The method according to claim 16, wherein a transceiver unit receives information regarding the status of the lock.

18. The method according to claim 16, wherein a monitoring unit receives information regarding the status of the lock from the lock status control unit and provides a visual display of the status of the lock.

19. The method according to claim 16, wherein the at least one wireless key unit transmits information obtained from the at least one lock tracking device regarding the status of the lock to the lock status control unit via a portable transceiver device.

* * * * *